United States Patent [19]

Salomon

[11] 4,205,467

[45] Jun. 3, 1980

[54] SKI BOOT

[75] Inventor: Georges P. J. Salomon, Annecy, France

[73] Assignee: Etablissements Francois Salomon et Fils, Annecy, France

[21] Appl. No.: 774,689

[22] Filed: Mar. 7, 1977

[30] Foreign Application Priority Data

Mar. 12, 1976 [FR] France ..... 76 07193

[51] Int. Cl.[2] ..... A43B 5/04

[52] U.S. Cl. ..... 36/119

[58] Field of Search ..... 36/119

[56] References Cited

U.S. PATENT DOCUMENTS

| | | | |
|---|---|---|---|
| 3,883,964 | 5/1975 | Check | 36/119 |
| 4,064,642 | 12/1977 | Vykokal et al. | 36/119 |

*Primary Examiner*—Patrick D. Lawson

*Attorney, Agent, or Firm*—Pollock, Vande Sande & Priddy

[57] ABSTRACT

In a ski boot designed to be put on from the rear, the foot-retaining system, located within a rigid shell, on a level with the metatarsus, comprises securing means consisting of two straps. One end of each strap is secured to the shell in the vicinity of the sole of the boot. The foot-retaining system is also provided with an adjustable tension device consisting of a bolt accessible from outside the boot, and nuts. A boot according to the present invention assures satisfactory foot retention in the metatarsal area, distributes the necessary pressure over all or part of the metatarsus, and allows the skier to adjust the loads which he applies.

23 Claims, 11 Drawing Figures

SKI BOOT

The invention relates to a ski boot, especially a boot designed to be fitted from the rear, and more particularly to a ski boot comprising a rigid shell and a foot-retaining system located within the shell on a level with the metatarsal bones.

Ski boots consisting of a shell and a foot-retaining system within it are already known.

According to French Pat. Nos. 1,587,643 (Kleinlagel), 2,075,412 (Lederer) and 2,045,321 (Head Ski), ski boots may be equipped with one or more straps located between the shell and the soft internal slipper on a level with the instep, for the purpose of altering satisfactory retention of the foot in the boot.

The arrangement of the foot-retaining system on a level with the instep appears to be preferably for rear-entry ski boots (French Pat. No. 1,587,642), since in this case the front part of the boot does not allow the shell to flex in order to adapt itself to the skier's foot. However, this retention of the foot may be considered inadequate by strong skiers or racing skiers, especially if it is on a level with the metatarsus. Furthermore, in the case of a rear-entry boot, no closure system provides satisfactory lateral and vertical retention of the skier's metatarsus.

In order to overcome this problem, U.S. Pat. No. 3,883,964 (Olin) provides a rigid plate located between the shell and the internal slipper and secured more or less firmly to the skier's sock by means of two screws accessible from the outside. This improves the retention of the foot in the metatarsal area.

However, this system has several disadvantages:

(1) The direction of the loads applied to the rigid plate between the shell and the sock is entirely vertical. The result of this is either poor transverse retention of the foot, or excessive vertical pressure to provide adequate transverse retention.

(2) The pressure screws are fitted to the rigid plate on the top of the boot on a level with the metatarsus. This relatively weak area must withstand the loads applied by the foot and transmitted by the plate, and may thus be deformed.

(3) The loads applied to the rigid plate by the shell are transmitted by screws. These heavy local loads may deform the plate and create painful pressure points on the top of the metatarsus.

(4) Since the screws bear upon the shell, the shell absorbs not only the loads required to retain the foot, but also all other loads applied thereto. For instance, when the skier is leaning forwards, the load and deformation applied to the shell are transmitted to the plate and are absorbed by the top surface of the metatarsus.

It is an object of the present invention to provide a ski boot, especially a rear-entry ski boot, comprising a foot-retaining system which:

(a) provides satisfactory vertical and transverse retention of the foot in the metatarsal region, while at the same time avoiding excessive vertical pressure upon the foot;

(b) does not require the top of the boot (the weakest area) to absorb any load;

(c) distributes the pressure required for satisfactory foot retention over all or part of the upper surface of the metatarsus;

(d) prevents the loads and deformations of the shell of the boot from reaching the metatarsus; and (e) may be adjusted by the skier.

In order to achieve these results the ski boot according to the invention comprises a foot-retaining system located within the rigid shell on a level with the metatarsal bones, the system comprising a support element located between the shell and the skier's foot and partially surrounding the latter, and an adjustable device for clamping the support element to the foot.

Furthermore, and according to one basic characteristic of the present invention, the clamping device comprises means for securing the support element, and an adjustable element for tensioning the securing means which at least partly surround the skier's foot.

This arrangement of the foot-retaining system in the metatarsal area eliminates painful pressure points on the joints. Moreover, since the securing means and the support element partly surround the skier's foot, and since the force providing the foot with satisfactory vertical and lateral retention is produced by a tensioning element, the loads are distributed over the periphery of the foot.

Furthermore, the securing means at least partly surrounding the foot cooperate with the adjustable tensioning element, and with the support element, in providing satisfactory lateral retention of the foot, without, in so doing, requiring an additional vertical force, and therefore without producing the disadvantages associated with this vertical force, as in the case of the boot described in the Olin patent (U.S. Pat. No. 3,883,964). In order to eliminate certain defects inherent in the latter patent, the securing means are located in the area of the sole of the boot, which is rigid and is not deformed when the skier is leaning forward.

Thus, since the securing means and the support element are completely independent of the top of the shell of the boot, they do not transmit the loads applied by the metatarsus. This arrangement of the securing means and support element therefore prevents deformation and deterioration of this relatively weak portion of the boot.

Conversely, loads applied to the top of the shell, particularly when the skier is in forwardly flexed position, are not transmitted to the skier's metatarsus, as they are in the case of the above-mentioned patent.

Since the device for clamping the support element to the foot is adjustable, the skier may adapt it to his needs. Preferably, and according to another characteristic of the invention, the adjustable device for tensioning the securing means comprises an actuating element accessible from outside the boot, an arrangement which facilitates adjustment of the retention of the foot in the boot. Sufficient play is provided between the shell and the actuating element to prevent deformation of the shell from being transmitted to the skier's foot.

Various embodiments of the present invention are conceivable.

In the first place, the components of the adjustable clamping device and support element may cooperate in different ways, for example:

(a) The securing means may be in the form of two straps each secured by one end to one side of the shell, in the vicinity of the sole, the other ends of the straps being connected to the adjustable element for tensioning the securing means; in this case, the securing means and the tensioning device at least partly surround the skier's foot, and the tensioning device assumes a position substantially above the metatarsus.

(b) The securing means may be in the form of a strap, one end of which is connected to the shell, near the sole, while the other end is connected to the tensioning device located on the other side of the shell, near the sole; in this case, the securing means at least partly surround the skier's foot. The tensioning device is preferably located on the outside of the boot, to prevent it from deteriorating.

(c) The securing means may be in the form of a strap totally surrounding the top of the skier's foot, i.e. all but the sole of the foot. In this case, the tensioning device may assume a position wholly or partly within the sole of the boot.

In the second place, the embodiments of the securing means may vary without departing from the scope of the present invention; for example, it is possible to use either flexible straps or a strip of flexible steel.

It is also conceivable to use rivets for securing the straps. Furthermore, it is desirable to arrange the clamping device at a slight angle to the transverse axis of the boot, so that the device runs substantially parallel with the tarsal-metatarsal and the toe-metatarsal joints.

In the third place, the adjustable device for tensioning the support element to the foot may be designed in various ways. For example:

(a) The tensioning device may consist of an adjustable locking element in the form of a hook. According to another characteristic of the invention, this locking element may be in the form of a hinged hook comprising a plurality of notches and an actuating element. This allows the skier to adjust the tension of the securing means by operating the hinged hook by means of the actuating element. According to a subsidiary characteristic of the invention, the adjustable hook locking element may contain at least one screw for adjusting the tension of the securing means, in which case the screw comprises the actuating element.

(b) The tensioning device may be in the form of a bolt-and-nut system, the rotation of one or the other of these parts altering the tension of the securing means.

The screw preferably has an actuating element at one end. More particularly, the actuating element consists of a lever hinged to the end of the bolt, pivoting about an axis at right angles to the axis of the latter, thus enabling the skier to rotate the bolt by placing the lever substantially at right angles thereto, and thus modifying the tension of the clamping means.

If, according to still another characteristic of the invention, the bolt is equipped with a locking element to prevent it from turning, this element is preferably integral with the shell; a lever such as that described above cooperates with the element to prevent the bolt from turning.

Sufficient play is provided between the lever, in its folded position, and the element on the shell (the shape of which complements that of the lever), to assure that the loads absorbed by the shell, especially when the skier is leaning forward, are not transmitted to the tensioning device, and thus to the skier's metatarsus.

In the fourth place, the actuating element and the tensioning device associated therewith may occupy various positions, namely at the side of the foot, on the top of the foot, or under the foot.

In the fifth place, the bolt and nut system which, in various embodiments constitute the tensioning device (equipped or not with an actuating element), may be designed in various ways as a function of the structure of the securing means, for example:

(a) If the securing means are in the form of two straps each secured by one end to one side of the shell, the tensioning bolt has a one left-hand thread and one right-hand thread. A nut secured to the free end of each strap is threaded onto the said bolt.

Rotation of the bolt causes the nuts to move in opposite directions, thus altering the tension of the straps and the force with which the support element is applied to the foot. The left and right-hand threads on the bolt may have the same pitch.

The foot is thus held symmetrically in the boot. However, this symmetry may be intentionally eliminated by providing left and right-hand threads of different pitches.

According to a subsidiary characteristic of the invention, the second nut, and therefore one of the threads, may be dispensed with. In this case, one of the straps is connected to the tensioning device by means of a ring sliding on the unthreaded end of the bolt. The movement of this ring is controlled by a cam hinged to the unthreaded end of the bolt and pivoting at right angles thereto. It is easily understood that the pivoting movement of the cam causes, or allows, the ring to move along the bolt in relation to the nut, and this alters the tension of the straps.

If, moreover, the tensioning device comprises an actuating element consisting of a lever integral with the cam, then the skier has two ways of adjusting the clamping device. He may set the lever at right angles to the axis of the bolt, rotate the bolt, and thus displace the nut, which provides fine adjustment of strap tension. Or he may displace the sliding ring, folding the lever into a position substantially parallel with the axis of the bolt; conversely, he may release the ring by lifting the lever. The skier may thus easily relax his foot while waiting or for walking, and then quickly restore the original pressure without readjusting the tension.

(b) Where the tensioning device is located one one side of the shell of the boot and associated with a strap secured by one end to the other side of the shell, the bolt of the tensioning device may be threaded and may pivot freely in a housing provided for this purpose in the boot. A nut is screwed onto the thread and is secured to the free end of the strap, thus connecting the strap to the tensioning device. Rotation of the bolt moves the nut in relation to the side of the shell to which the tensioning device is attached. This alters the tension of the strap and thus the pressure applied by the support element to the foot.

Where the securing means are in the form of a strap, each end of which is secured to a nut running upon a threaded rod, the bolt of the tensioning device is mounted in the sole of the boot and has a left-hand and a right-hand thread. Rotation of the bolt thus causes the nuts to move in opposite directions, thus altering the tension of the strap and the force with which the strap is applied.

In the sixth place, the support element partly surrounding the skier's foot may be designed in various ways. Although it is not essential to arrange a sock between the foot and the support element, it is desirable to do so in order to avoid the pain that may be caused by failure to provide the sock. According to another characteristic of the invention, the support element comprises a rigid plate adapted to the part of the foot against which it is designed to bear. This adaptation of the plate to the part of the foot, or to the sock, to which it applies pressure, has the effect of distributing the pressure over a wide area.

In this case, the securing means are as a rule in the form of straps surrounding the support element, the latter being located between the foot and the straps. It should be pointed out, however, that in certain variants, the support element may be constituted directly by the strip proper or, to be more precise, by the part of the strap in contact with the foot.

A detailed description will now be given of a few variants of the boot according to the invention, with reference to the drawings attached hereto, the variants being in no way restrictive. In the drawings.

A detailed description will now be given of FIG. 5, which is a plan view of the bones of the foot, showing the area involved in the invention. In order to avoid applying pressure to the foot at the joints, it has been decided to apply the pressure in metatarsal area 35, defined by the tarsal-metatarsal joint 36-35 and the toe metatarsal joint 37-35 (the unhatched portion of the figure). This avoids the creation of painful pressure points at the joints.

A description will now be given of FIG. 1 which is a perspective view of one embodiment of the invention, and of FIG. 2 which is a cross section through a detail of this embodiment.

Figure 1:
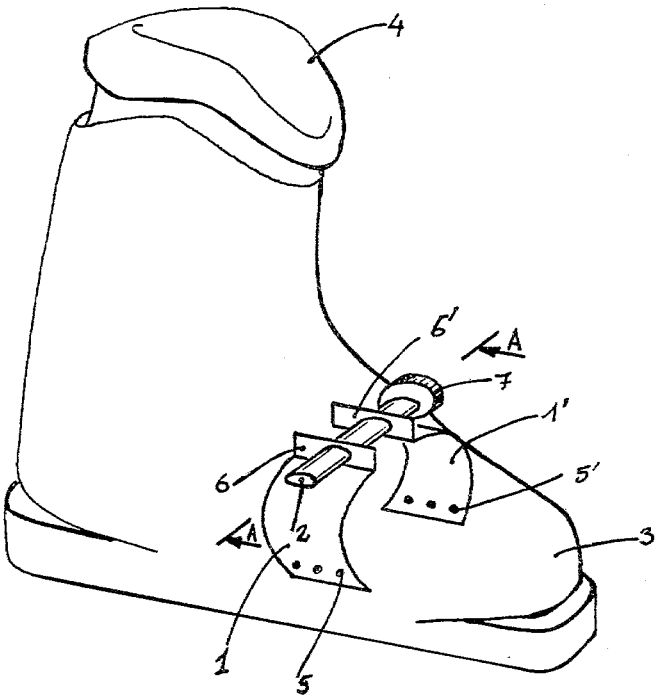
FIG. 1 is a perspective view of one embodiment of the invention.

The boot, in this case, consists of a shell 3, possibly in several parts, equipped with an opening system not shown in FIG. 1, and of a sock 4 within the shell. The securing means are in the form of two straps, or the like, 1 and 1', located between shell 3 and sock 4 on a level with the metatarsus. These straps are secured by one end to shell 3, in the vicinity of the sole of the boot, by means of a row of rivets 5,5', or the like. In this embodiment, the adjustable tension device is in the form of a bolt-and-nut system which will now be described. The two free ends of the straps are connected (in the central portion of the boot) to nuts 6,6'. These nuts run upon a bolt 2 having a right and a left-hand thread. The bolt is free to rotate and is accessible from outside the boot. By rotating knurled knob 7, nuts 6,6' are moved towards or away from each other, as are the ends of straps 1,1', thus adjusting the retention of the foot in its housing.

Figure 2:
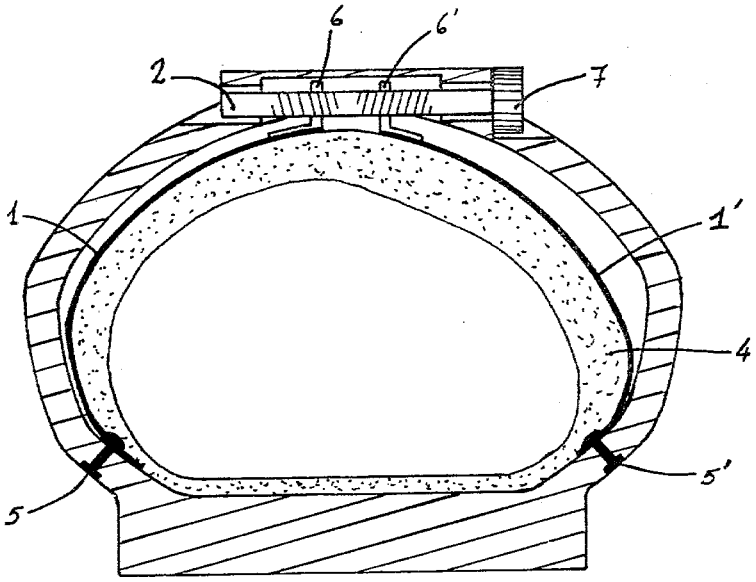
FIG. 2 is a cross section at line A—A of the embodiment illustrated in FIG. 1.

It will be observed in FIG. 2 that play is provided between shell 3 and bolt 2. This prevents the deformations of the shell (arising, for example, when the skier is leaning forward) from being transmitted to the skier's foot. A variation of this first embodiment could be obtained by using a single strap and a single nut, with the bolt still located in the central plane of the boot. In this case, the bolt is displaced in relation to the shell and the skier's foot is pressed against one side of the boot, which has the disadvantage of destroying the foot-boot symmetry.

Figure 3:
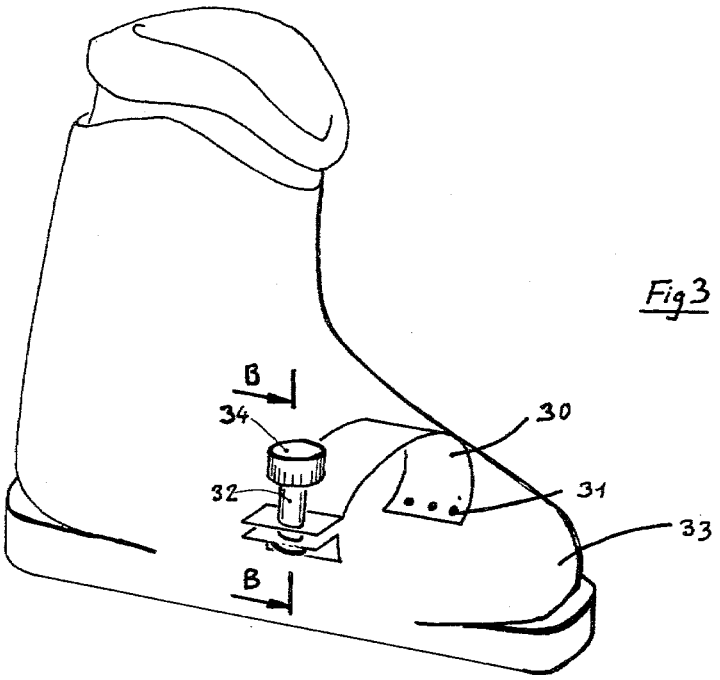
FIG. 3 is a perspective view of another embodiment.
Figure 4:
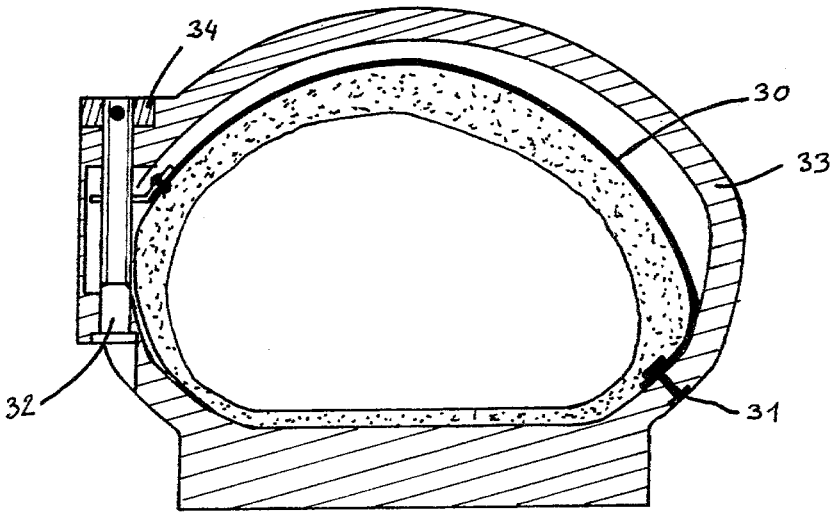
FIG. 4 is a cross section at line B—B of the embodiment illustrated in FIG. 3.

A description will now be given of FIG. 3, which is a perspective view of a second embodiment, and of FIG. 4 which is a cross section through a detail of this second embodiment.

In this variant, the skier's foot is surrounded by a single strap secured to one side only of the boot, near the sole, by means of rivets 31. On the other side, this strap is tensioned by means of a bolt 32 tangential to shell 33 and actuated by a knurled knob 34. This adjustable tension device is preferably arranged on the outer side of the boot, in order to facilitate actuation and prevent deterioration of the adjustable tension device.

Figure 7:
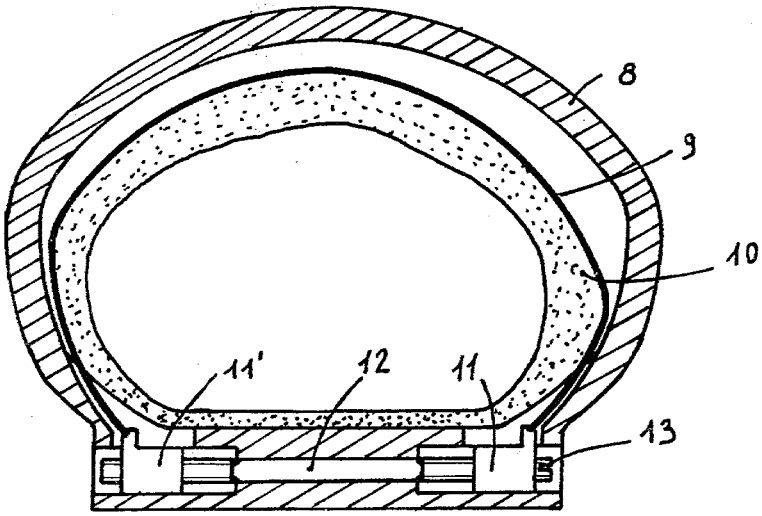
FIG. 7 is a cross section through another embodiment of the invention.

A description will now be given of FIG. 7 which illustrates a third embodiment.

In this case, shell 8 is equipped with a strap 9 surrounding the top and sides of the foot and located between shell 8 and sock 10. Each end of strap 9 is secured to nuts 11,11' running on the same right-hand and left-hand threaded rod 12. This rod has a slot 13, or the like, by means of which it may be rotated by the skier, in one direction or the other, in order to adjust the retention of his foot in shell 8.

Figure 5:
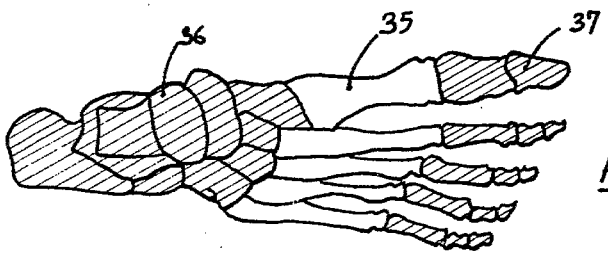
FIG. 5 is a plan view of the bones of the foot, showing the area involved in the invention.

It should be noted that it is desirable to arrange straps 1,1', 30 and 9 at a slight angle to the transverse axis of the boot, so that the straps run substantially parallel with the tarsal-metatarsal and toe-metatarsal joints of the foot (as shown in FIG. 5).

The foregoing embodiments all make use of a bolt-and-nut system for tensioning the straps. This system may, however, be replaced by a catch, hook, or the like, without departing from the scope of the invention.

The pressure applied by the bolt-and-nut system in each of the foregoing embodiments may be transferred to the sock or foot through a load-distributing plate designed to reduce the loads applied to the foot. In the interests of clarity, this plate is not shown in FIGS. 1, 2, 3, 4 and 7.

It should be noted that this plate is not absolutely essential, since the support element transmitting the forces which hold the foot in place may consist directly of the straps proper or, to be more precise, of the parts of the straps in contact with the foot.

Figure 6:
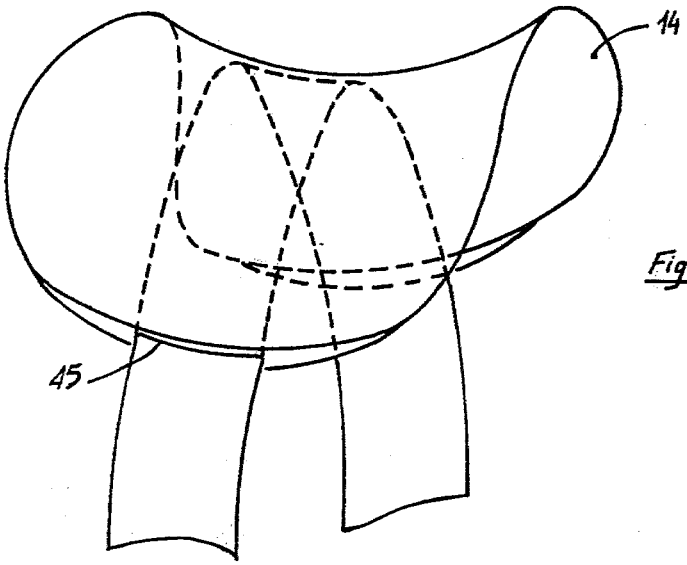
FIG. 6 is a perspective view of a plate designed to distribute the loads applied by the straps to the sock or foot.

A description will now be given of FIG. 6, which illustrates a plate of this kind. Plate 14 is introduced between the straps and the foot, or between the straps and the sock. The geometry of this plate must correspond to that of the part of the sock or foot with which it is in contact, the area of the plate being large enough to reduce the pressure upon the foot and eliminate painful pressure points. The plate may have a slot 45 across its entire width, through which the strap is passed, in order to prevent the plate from assuming a position incompatible with the comfort of the foot.

Figure 8:
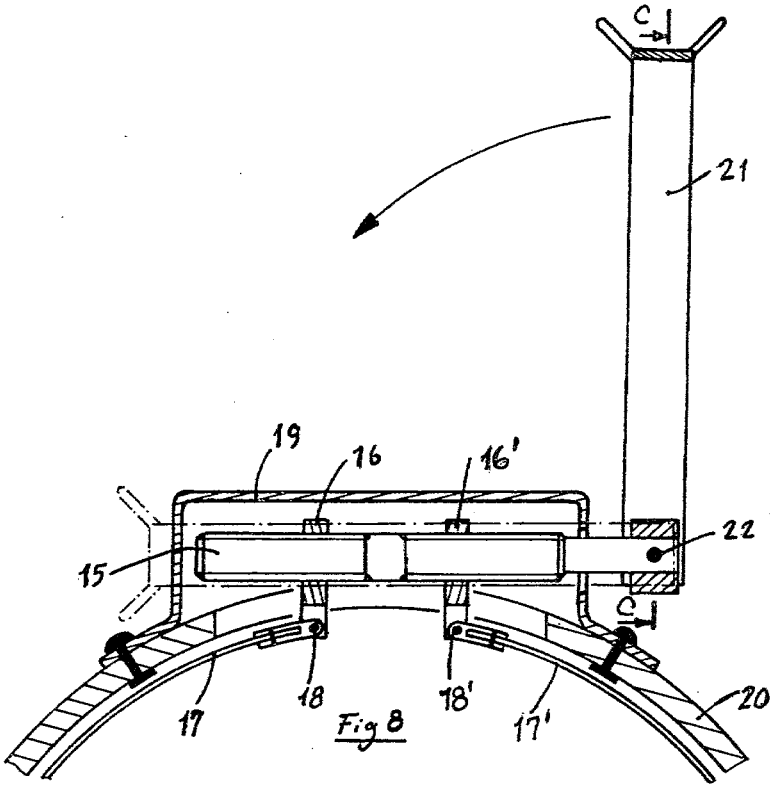
FIG. 8 is a cross section through a special adjustable tensioning device (the dotted lines showing the lever in the folded position)
Figure 9:
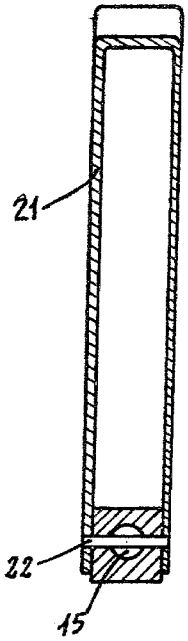
FIG. 9 is a cross section through FIG. 8 seen from the left.

A description will now be given of FIG. 8, which is a cross section through a special tension device, and of FIG. 9 which is a cross section through FIG. 8, as seen from the left. This tension device is an improvement to the device illustrated in FIGS. 2, 4 and 7. Bolt 15 has a right and a left-hand thread carrying nuts 16,16', each connected to one end of straps 17,17' by split pins 18,18'.

Bolt 15 is protected by a housing 19 secured to shell 20 and surrounds the entire bolt. One end of bolt 15 projects from housing 19, to allow the bolt to be actuated. A considerable amount of play is provided between shell 20 and bolt 15, to ensure that the retention of the foot is in no way altered by deformations in the shell. A lever 21 is hinged to the free end of bolt 15, by means of a split pin 22, at right angles to the axis thereof, to allow the bolt to be rotated. Since bolt 15 has left and right-hand threads, nuts 16,16' move along it in opposite directions when it is rotated, thus tightening or loosening straps 17,17'. Lever 21 allows the bolt to be rotated through 180° at one time. If it is desired to continue to rotate the bolt, lever 21 may be pivoted about its axis 22 to the opposite position, whereupon the bolt may again be rotated through 180°. Lever 21 is made of sheet metal bent into the shape of a U, the width of the U being sufficient to allow the lever to be folded onto housing 19 which then fits into the U. The strap tension is preferably adjusted in such a manner that, at the conclusion of the adjustment, lever 21 is in the vertical position (FIG. 8). Folding the lever in the direction of the arrow in FIG. 8, onto housing 19, then locks the bolt, preventing it from rotating and makes the tensioning system more compact.

A description will now be given of FIG. 10, which is a cross section through another tension device, and of FIG. 11, which is a cross section through FIG. 10 as seen from the left. This is an improvement of the special tension device shown in FIGS. 8 and 9. In this design, bolt 23 has a single thread upon which a nut 24 runs. One end of strap 25 is secured to nut 24 by means of a split pin 26. The second strap, 27, is secured to a ring 28 by means of a split pin 29. This ring is adapted to slide freely upon the smooth part of threaded rod 23. Straps 25,27 are adjusted, as before, by means of a lever 39 hinged, by means of a split pin 40, to the free end of bolt 23. It should be noted that, as before, a considerable amount of play is provided between ring 28 and housing 41, so that deformations of the shell of the boot do not affect the retention of the foot.

Figure 10:
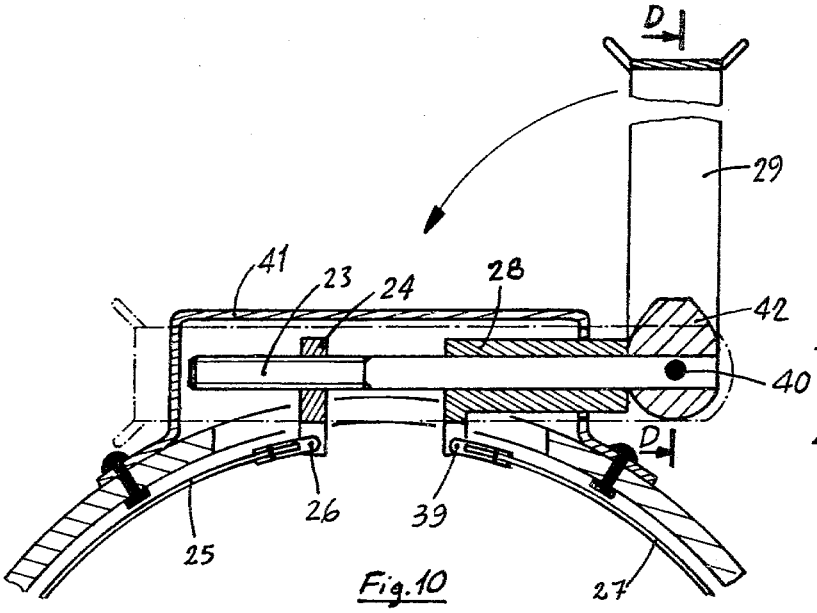
FIG. 10 is a cross section through another form of adjustment (the dotted lines showing the lever in the folded position)
Figure 11:
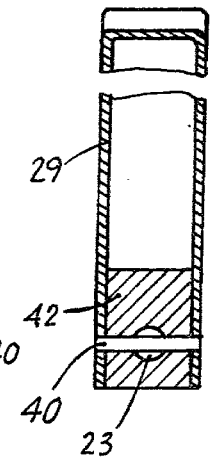
FIG. 11 is a cross section through the means of adjustment illustrated in FIG. 10.

Of special interest in this system is the additional tightening of the straps by means of an eccentric, or cam, 42 bearing against ring 28 when lever 39 is pivoted about its axis 30 in the direction indicated by the arrow in FIG. 10. Thus when he is waiting in line, or walking, the skier may easily remove pressure from his foot, merely by rotating lever 39 about axis 40. As soon as the skier wishes to restore the original tension, he needs only fold down lever 39, without any further adjustment of the strap tension.

The pressure release obtained merely by lifting lever 29 may be sufficient to allow the foot to be withdrawn from the boot. In this case, rotation of the bolt is merely a means for adjusting the retention of the foot and is not used for removing the boot.

What is claimed is:

1. A boot, more particularly a ski boot, comprising
(a) a rigid shell; and
(b) a foot retaining system located within said shell on a level with the metatarsal bones and mounted on each side of the longitudinal axis of the interior of said shell, said system comprising
(i) a support element located between said shell and the skier's foot and curvedly surrounding at least a part of said foot; and
(ii) an adjustable device for clamping said support element to said foot, said clamping device comprising
(A) means for securing said support element to said shell; and
(B) an adjustable element for tensioning said securing means by the application of longitudinal traction, said adjustable element comprising an actuating means accessible from the outside of said boot when said boot is being worn, said securing means at least partly surrounding the skier's foot.

2. A boot according to claim 1, wherein said securing means comprises two straps each secured by one end to one side of said shell, close to the sole of said boot, the other ends of said straps being connected to said tensioning device, and said securing means and tensioning device surrounding at least a part of the skier's foot.

3. A boot according to claim 1, wherein said securing means comprises a strap secured by one of its ends to one side of said shell, close to the sole of said boot, the other end of said strap being connected to said tensioning device mounted on the other side of the shell, close to the sole of said boot, and said securing means surrounding at least a part of the skier's foot.

4. A boot according to claim 1, wherein said securing means comprises a strap totally surrounding the top of the skier's foot, but not the sole of the foot.

5. A boot according to claim 1, wherein said tensioning device is in the form of an adjustable hook locking element.

6. A boot according to claim 5, wherein said locking element comprises a hinged catch equipped with a plurality of notches and with said actuating means, whereby the skier may adjust the tension of said securing means, in accordance with the morphology of his foot, by actuating said hinged catch by means of said actuating means.

7. A boot acording to claim 5, wherein said locking element comprises at least one bolt for adjusting the tension of said securing means, said bolt comprising said actuating means.

8. A boot according to claim 1, wherein said tensioning device comprises a bolt-and-nut system.

9. A boot according to claim 8, wherein one end of said bolt carries said locking element.

10. A boot according to claim 9, wherein said actuating means is in the form of a lever hinged to the end of said bolt, and pivoting about an axis at right angles to the axis of said bolt, in such a manner that, by placing said lever substantially at right angles to the axis of said bolt, the skier may rotate said bolt.

11. A boot according to claim 10, wherein said bolt is fitted with a locking means to prevent it from rotating.

12. A boot according to claim 11, wherein said locking means is integral with said shell, and is of a shape complementary to that of said lever, said lever being adapted to bear against said locking means after pivoting about its hinge.

13. A boot according to claim 1, wherein said actuating means and said tensioning element are located at the side of the foot.

14. A boot according to claim 1, wherein said actuating means and said tensioning device are located on the top of the foot.

15. A boot according to claim 1, wherein said actuating means and said tensioning device are located under the foot.

16. A boot according to claim 2, wherein said tensioning device comprises a bolt-and-nut system; said bolt having a left and a right-hand thread; said straps being connected to said tensioning device by means of two nuts to which they are secured, one of said nuts running on said left-hand thread and one on said right-hand thread whereby, by rotating the bolt with said actuating means, the skier causes said nuts to move in opposite directions, thus adjusting the tension of said straps and the load applied by said support element to said foot.

17. A boot according to claim 3, wherein said tensioning device comprises a bolt-and-nut system; said bolt pivoting within a housing provided in said boot, and having a single thread; said strap being connected to said tensioning device by means of a nut to which it is attached, said nut running on said thread whereby, by rotating said bolt with said actuating means, the skier causes said nuts to move in opposite direction, thus adjusting the tension of said strap and the load applied by said support element to said foot.

18. A boot according to claim 2, wherein said tensioning device consists of a bolt-and-nut system; one end of said bolt is threaded; one of said straps being connected to said tensioning device by means of a nut to which it is attached and which runs on said thread; the other strap being connected to said tensioning device by means of a ring sliding upon the other end of said bolt; said sliding ring being actuated by a cam hinged to said other end of said bolt and pivoting about an axis substantially at right angles to the axis of said bolt.

19. A boot according to claim 18, wherein one end of said bolt carries said locking element, said actuating means being in the form of a lever integral with said cam, whereby, by setting the lever substantially at right angles to the axis of said bolt, the skier may rotate said bolt, and by folding the lever down to a position substantially parallel with said axis of the bolt, said skier may cause the ring to slide.

20. A boot according to claim 1, wherein said tensioning device consists of a bolt, one end of which is threaded and carries a nut, while the other end carries a sliding ring actuated by a cam hinged to said other end and pivoting about an axis substantially at right angles to the axis of said bolt; said securing means connecting said nut and said ring, respectively, to the boot on each side of the foot; said actuating means being integral with said cam whereby, by setting the lever substantially at right angles to the axis of said bolt, the skier may rotate said bolt, and by folding the lever down to a position substantially parallel with the axis of said bolt, the skier may cause said ring to slide.

21. A boot according to claim 1, wherein said support element is equipped with a rigid plate shaped to the part of the foot upon which it is designed to bear whereby the pressure arising from the tensioning of said securing means is distributed over a wide area.

22. A boot according to claim 1, comprising securing means consisting of at least one strap, said support element being constituted by that part of said securing means that is in contact with the foot.

23. A boot according to claim 1, comprising securing means consisting of at least one strap; said strap surrounding said support element.

* * * * *